US006244786B1

(12) United States Patent
Johansson

(10) Patent No.: US 6,244,786 B1
(45) Date of Patent: Jun. 12, 2001

(54) METHOD FOR OFFSHORE LOAD TRANSFER OPERATIONS AND, A FLOATER FOR OFFSHORE TRANSPORT INSTALLATION AND REMOVAL OF STRUCTURAL ELEMENTS

(75) Inventor: Per Johansson, Oslo (NO)

(73) Assignee: Master Marine AS, Lysaker (NO)

( * ) Notice: Subject to any disclaimer, the term of this patent is extended or adjusted under 35 U.S.C. 154(b) by 0 days.

(21) Appl. No.: 09/444,583

(22) Filed: Nov. 22, 1999

(30) Foreign Application Priority Data

Dec. 7, 1998 (NO) ..... 19985714

(51) Int. Cl.[7] ..... F02D 5/54; B63B 21/27

(52) U.S. Cl. ..... 405/224.1; 405/196; 405/195.1; 114/296

(58) Field of Search ..... 405/224.1, 224, 405/223, 195.1; 114/296, 256, 264, 266, 294

(56) References Cited

U.S. PATENT DOCUMENTS

| | | | | |
|---|---|---|---|---|
| 3,366,088 | * | 1/1968 | Gibson et al. | 114/296 |
| 3,496,900 | * | 2/1970 | Mott et al. | 405/224 |
| 3,934,528 | * | 1/1976 | Horton et al. | 405/224 |
| 4,048,945 | * | 9/1977 | Shrum | 114/294 |
| 4,318,641 | * | 3/1982 | Hogervorst | 405/224 |
| 4,556,004 | | 12/1985 | Lamy et al. . | |
| 4,572,304 | * | 2/1986 | Mahar et al. | 114/296 |
| 5,403,124 | | 4/1995 | Kocaman et al. . | |
| 6,113,315 | * | 9/2000 | Fulton et al. | 405/224.1 |

FOREIGN PATENT DOCUMENTS

| | | |
|---|---|---|
| 3327702 | 2/1985 | (DE) . |
| 2 168 293 | 6/1986 | (GB) . |
| WO 97/30888 | 8/1997 | (WO) . |

* cited by examiner

*Primary Examiner*—Eileen D. Lillis
*Assistant Examiner*—Frederick L. Lagman
(74) *Attorney, Agent, or Firm*—Barry R. Lipsitz

(57) ABSTRACT

A floater that is U-shaped in plan view for offshore load transfer is provided with storage/deployment apparatus for suction anchors. The suction anchors are placed in the seabed directly from the floater and are connected to the floater by adjustable tethers. The individual tethers are adjusted to attenuate relative motions between floater and seabed and to attenuate rolling motions of the floater during a load transfer.

22 Claims, 5 Drawing Sheets

METHOD FOR OFFSHORE LOAD TRANSFER OPERATIONS AND, A FLOATER FOR OFFSHORE TRANSPORT INSTALLATION AND REMOVAL OF STRUCTURAL ELEMENTS

The invention relates to a method for offshore load transfer operations, wherein a floater is taken to a transfer site at sea and loads are transferred between the transfer site and the floater, the floater being anchored to the seabed with anchors prior to the load transfer.

The invention also relates to a floater having adjustable buoyancy for offshore transport, installation and removal of structural elements.

The invention has been especially developed in connection with the need for the mounting and dismantling of large structural elements offshore, especially in connection with the removal of existing fixed platform installations at sea.

Basically, the floater may have any form that is adapted to or suitable for offshore transport, installation and removal of structural elements. The floater may thus, for example, be of the type taught in NO 135056, which illustrates and describes a derrick barge, or it may be a catamaran-like floater, for example, as taught in U.S. Pat. No. 3,078,680. Other embodiments of suitable floaters can be found in EP 000 462 A1, FR 247 992, NO 160424 and NO 171495.

Mounting and dismantling of large structural elements offshore requires an accurate, careful load transfer, both when retrieving the load and when putting it in place.

One of the main objects of the present invention is to permit an accurate, careful load transfer of this kind in a favourable and expedient manner.

Briefly, the inventive idea is that a floater is used which is provided with storage and deployment apparatus for suction anchors. The suction anchors are placed in the seabed without the use of support vessels and are attached to the floater by means of adjustable tethers or tendons.

Once the suction anchors have been placed in the seabed, the individual tethers are adjusted to attenuate relative motions between floater and seabed and to attenuate the rolling motion of the floater during a load transfer. A major advantage of the invention is that the floater can be swiftly anchored as soon as it has reached its destination, and can be kept anchored by means of the adjustable tethers attached to the suction anchors. Once the load transfer operation has been completed, the suction anchors are released from the seabed and taken up. Optionally, the suction anchors can remain on the seabed, only the tethers being disconnected.

According to the invention a method is thus proposed for offshore load transfer operations, wherein a floater is taken to a transfer site at sea and a load is transferred between the transfer site and the floater, the floater being anchored to the seabed by means of anchors prior to the load transfer, and what characterises the method according to the invention is that the anchoring is carried out by placing suction anchors connected to the floater via attached adjustable tethers in the seabed directly from the floater, and by adjusting the individual tethers to attenuate relative motion between floater and seabed and to attenuate rolling motions of the floater during a load transfer.

According to the invention a floater having adjustable buoyancy is also proposed for offshore transport, installation and removal of structural elements, which floater according to the invention is characterised in that it is equipped with suction anchors with adjustable tethers attached thereto, so arranged that during load transfer operations involving the structural elements they can be placed in the seabed in such manner that relative motions between the floater and the seabed and rolling motions of the floater can be attenuated by adjusting the attached adjustable tethers.

According to the invention, the floater may to advantage have suction anchors which are attached to a respective pump for the provision and maintenance of a negative pressure in the suction anchor.

It would be particularly advantageous if the suction anchors were stored on board the floater above the waterline.

An advantageous embodiment of a floater is one which includes two parallel groups of elements, each group including a pontoon having a horizontal axis and, projecting upwards from the pontoon, columns which at the upper ends thereof are connected to a horizontal beam, and the groups are fixedly interconnected at one end to form a floater that is U-shaped in plan view. According to the invention, a floater of this type may be characterised in that in the area at the comers of the U and at the end of each leg of the U there is provided a respective storage/deployment apparatus for a suction anchor.

Each pontoon may advantageously be attached to one or more propulsion units, it being an advantage that the pontoons should have a respective bottom which is drawn up at each end in order thereby to make room for the respective propulsion unit so that it does not project down below the bottom.

As propulsion unit, it may be especially advantageous to use a Voith propeller.

Advantageously, the fixed connection between the groups below the waterline may consist of a crossbeam having a wing profile between the two pontoons.

Above the waterline, the horizontal beams may advantageously be interconnected by a crossbeam extending between two beam ends and together with the horizontal beams form a U-shaped box structure.

It is especially advantageous if the horizontal beams include gravity-discharge ballast tanks.

The invention will now be described in more detail with reference to the drawings, wherein.

Figure 1:
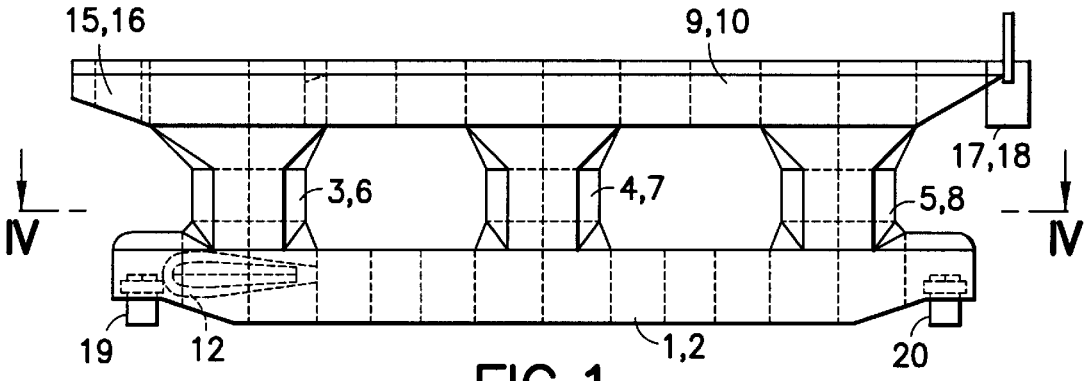
FIG. 1 is a side view of a floater according to the invention.

The floater illustrated in FIGS. 1–4 comprises two parallel groups of elements. Each of these groups includes a pontoon 1, 2 having a horizontal axis. From the respective pontoon 1, 2, columns 3, 4, 5 and 6, 7, 8 project upwards. The upwardly projecting columns in each group at the upper ends thereof are interconnected by means of a horizontal beam 9, 10, and these two horizontal beams 9, 10 at one end of the floater (to the left in FIGS. 1 and 2) are connected to one another by means of a horizontal crossbeam 11.

The two horizontal beams 9, 10 and the horizontal crossbeam 11 connecting them are provided with ballast tanks capable of being emptied rapidly by opening suitable, non-illustrated valves (gravity discharge).

Beneath the horizontal beam 11 the two pontoons 1 and 2 are connected to one another by means of a horizontal crossbeam 12 designed to have a wing profile.

The pontoons and optionally the wing profile are also constructed having ballast tanks. The ballast tanks at both the pontoon level and the deck level are provided with non-illustrated ballast filling/discharge means (pumps).

As can be seen from FIGS. 1–4, the floater has a typical U-shape in plan view. The open end of the U can be closed using a hinged boom device 14.

The floater may have four storage/deployment apparatus 15, 16, 17 and 18. Two of the apparatus, namely the apparatus 15, and 16 are located in the area at the bottom comers of the U, and the two other apparatus, 17, 18 are located at each side of a horizontal deck beam 9, 10.

As shown, the storage/deployment apparatus 15–18 are located so that the suction anchors when released into the sea will run clear of the underlying pontoon ends.

Figure 2:
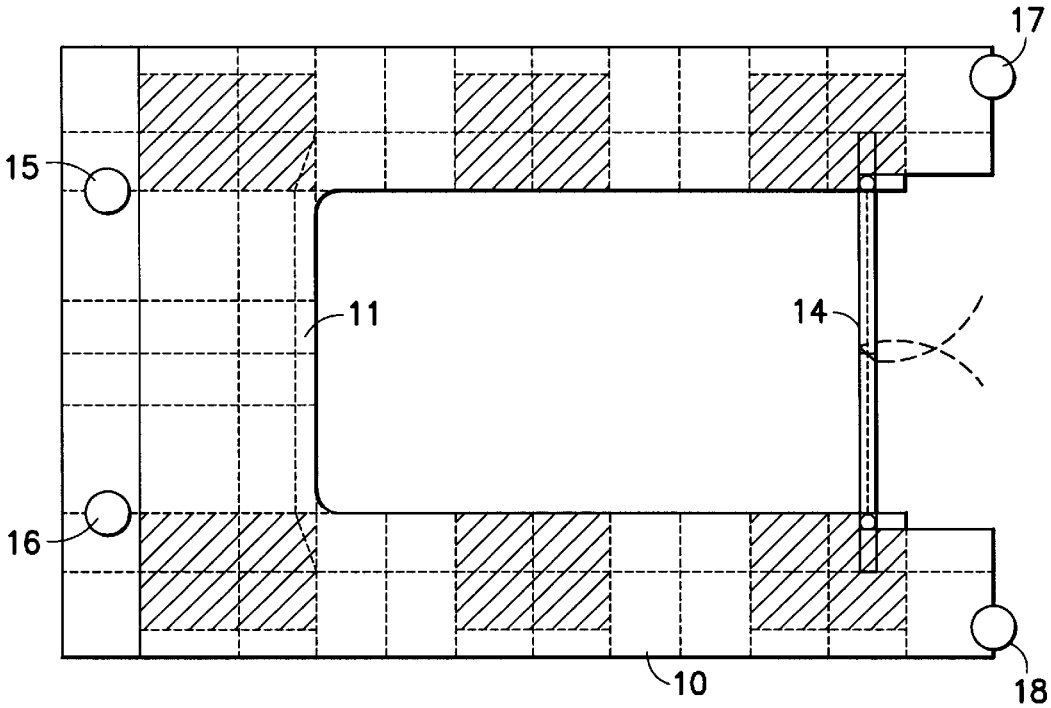
FIG. 2 is a horizontal projection of the floater in FIG. 1.
Figure 3:
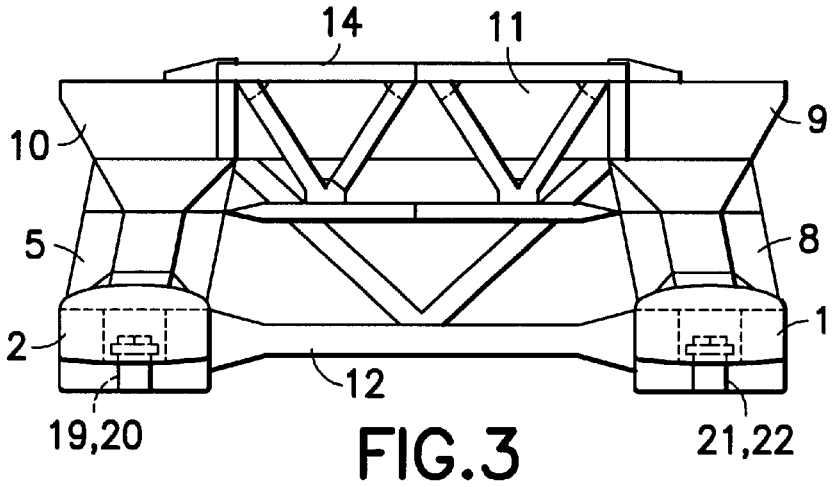
FIG. 3 is an end view of the floater, seen from the right in FIGS. 1 and 2.
Figure 4:
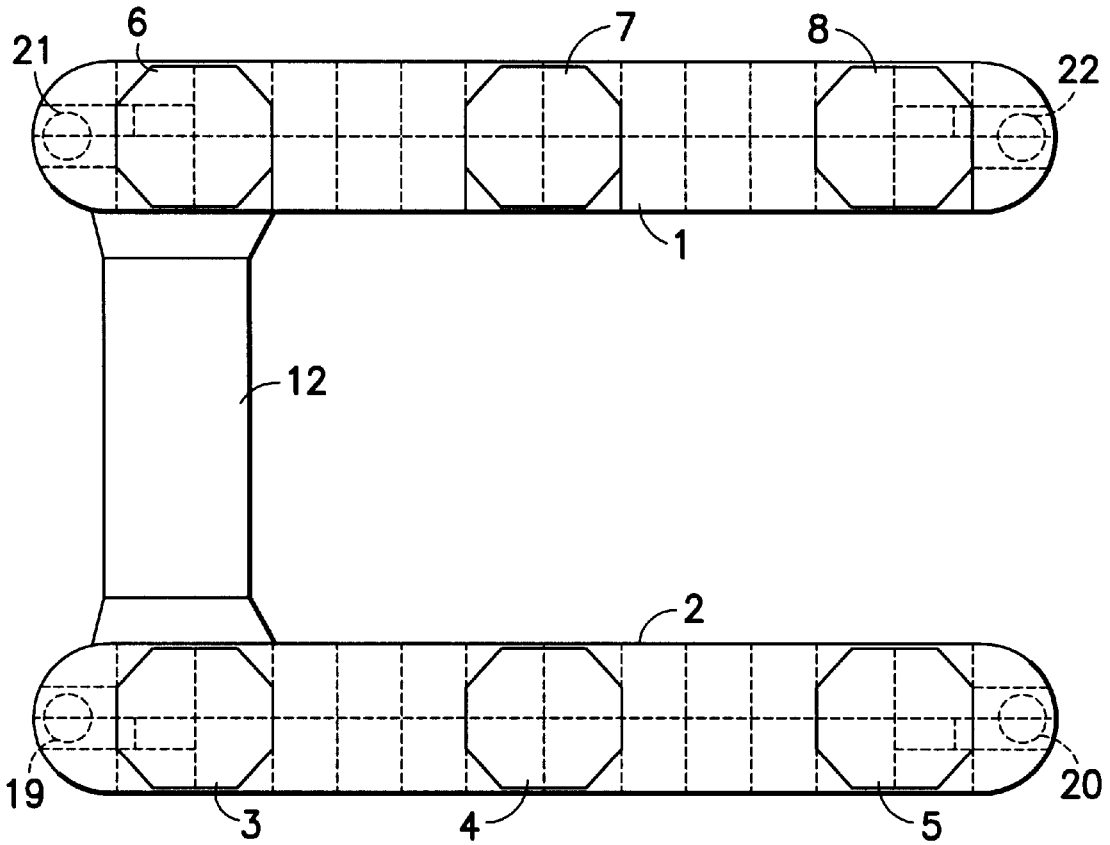
FIG. 4 shows a horizontal section through the floater along the line IV—IV in FIG. 1.

Each pontoon has two propulsion units 19, 20, 21, 22. As shown in FIGS. 2 and 3, the bottom of the pontoons 1, 2 is drawn up at the pontoon ends so that the propulsion units 19–22 will not project down below the bottom of the respective pontoon 1, 2. This gives the floater reduced draught and provides a protected arrangement of the propulsion units, which, as indicated, may advantageously be in the form of so-called Voith propellers.

Figure 5:
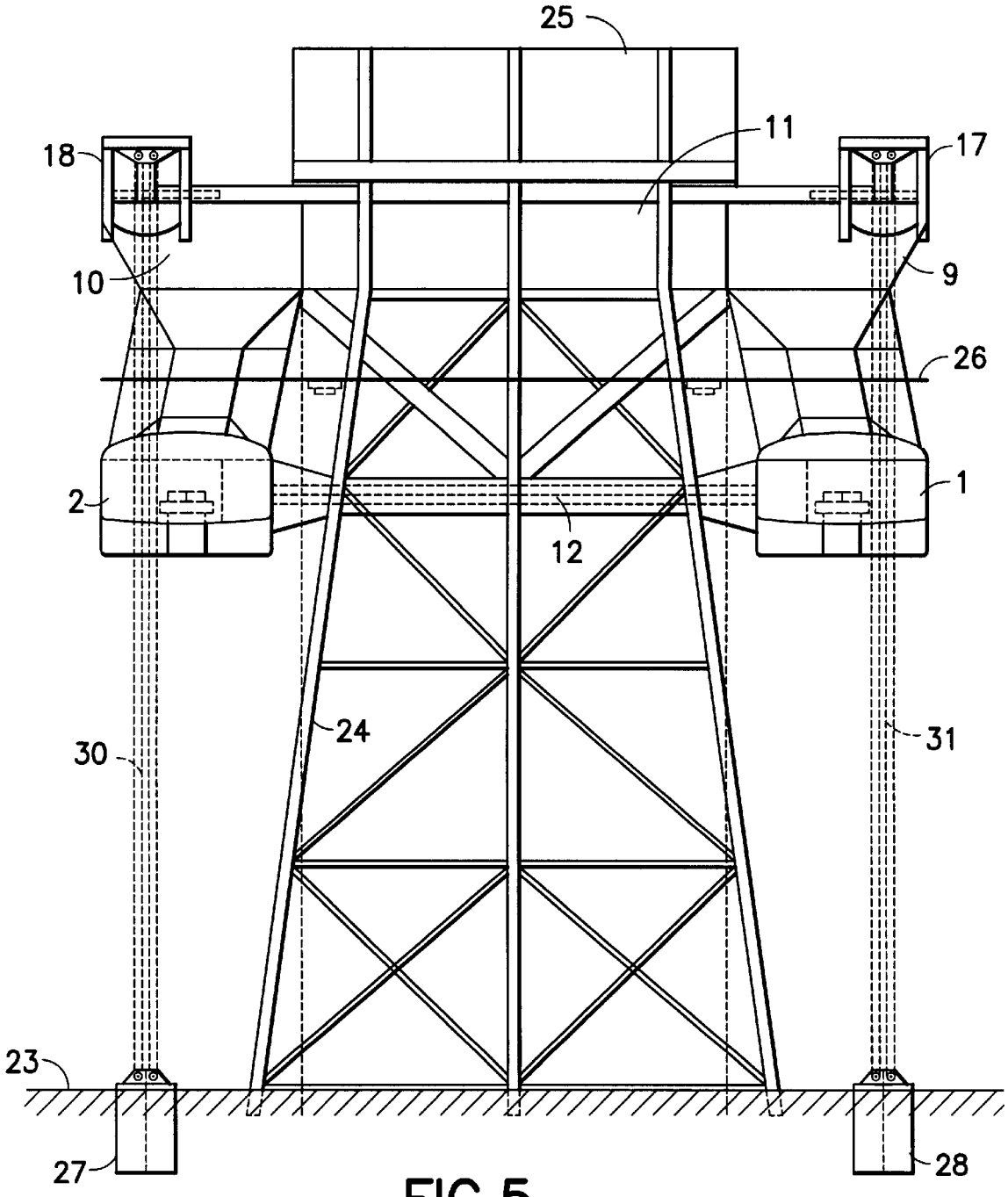
FIG. 5 is an end view of the floater in a position around a pylon in the sea.
Figure 6:
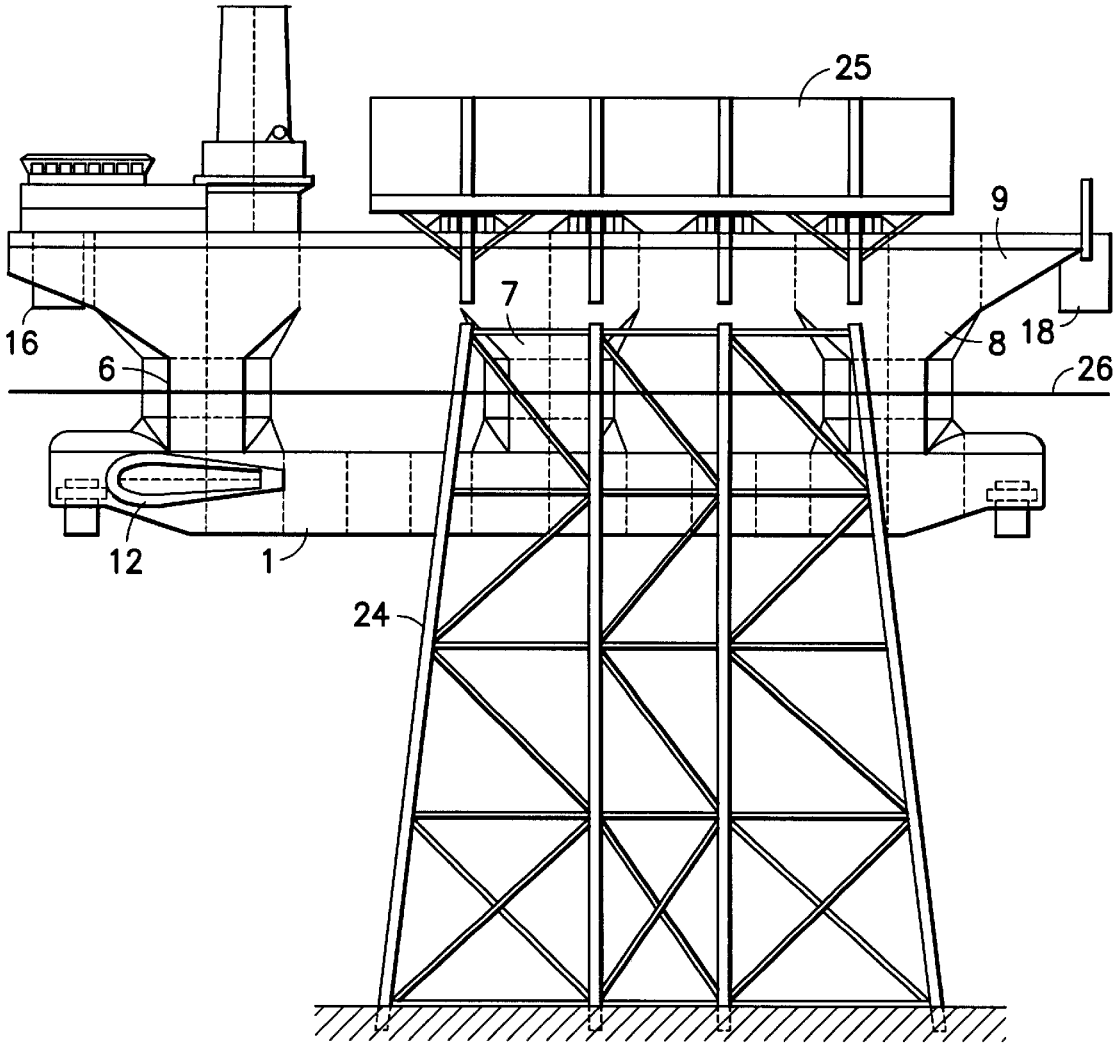
FIG. 6 is a side view of the floater positioned around a pylon in the sea, as in FIG. 5, but where the floater has been deballasted, so that a deck structure is resting on the floater.

In FIGS. 5 and 6 the floater is shown in a position for retrieving a structural element in connection with dismantling an offshore platform.

A pylon 24 stands on the seabed 23 and supports a deck structure 25 above the surface of the water 26. The floater has been brought into position around the pylon for retrieving the deck structure 15, i.e., that the floater is so manoeuvred that the pylon is located inside the free space between the pontoons 1, 2 and the horizontal deck beams 9, 10.

The floater is shown anchored to the seabed 23 by mans of suction anchors 27, 28 (only two anchors are shown in FIG. 5) which by means of adjustable tethers 30, 31 are attached to the floater, or more specifically the respective storage/deployment apparatus 18, 17. Of course, similar adjustable tethers also run from the two other storage/deployment apparatus down to suction anchors that are not illustrated here.

In FIG. 5 the floater is shown in a position where it has become connected to the deck structure 25, in a non-illustrated manner.

In FIG. 6, where only one half of the floater is shown, the floater is shown once it has been deballasted, by rapid emptying of the ballast chamber in the deck beams 9, 10, 11 and slackening the tethers, so that the deck structure is thereby lifted up from the pylon 24 and now in fact rests on the floater.

The floater may then release its mooring and move away from the pylon 24, taking with it the deck structure 25 resting on the floater deck.

As adjustable tethers 30, 31 it is advantageous to use wires in tackle systems, with associated hydraulic heave compensators on board the floater, for example, four heave compensators with attached tackle system in each storage/deployment apparatus 15–18.

Figure 8:
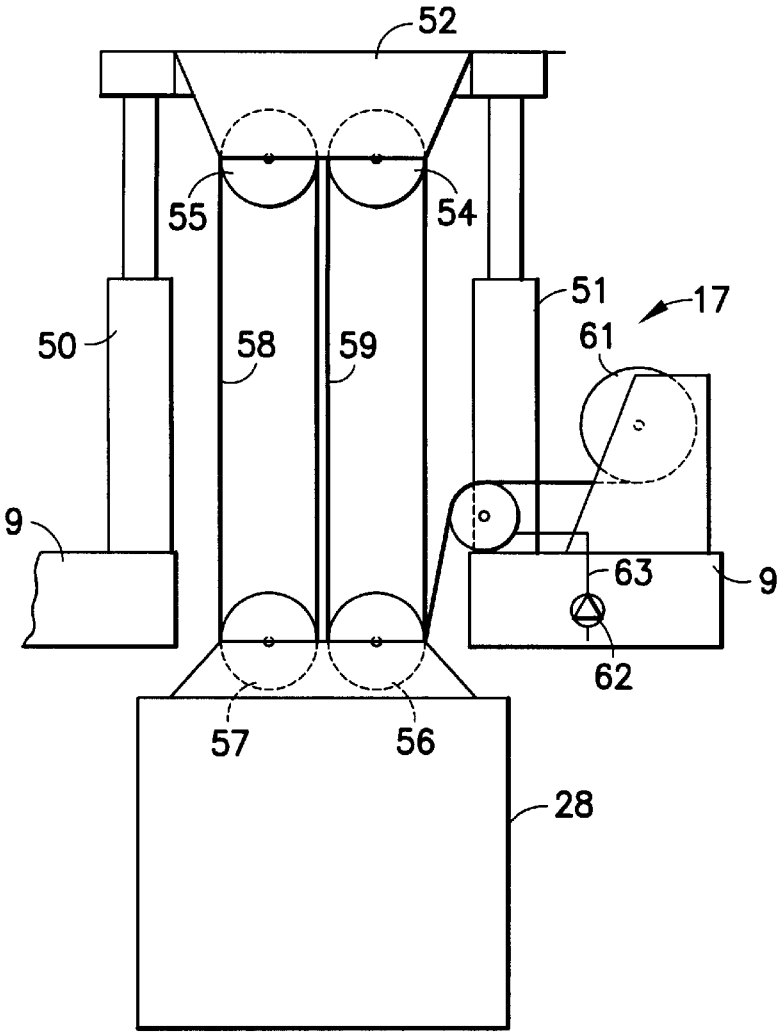
FIG. 8 is a schematic illustration of a tensioning arrangement for a suction anchor.

FIG. 8 shows a storage/deployment apparatus, for example, the apparatus 17. The other storage/deployment apparatus 15, 16 and 18 are designed in the same way.

On the deck, i.e., on the top of in this case the horizontal beam 9, hydraulic jacks 50, 51 are mounted. These jacks support a yoke 52 wherein there is supported in this case four sheaves 54, 55 (only two are shown). Similar sheaves 56, 57 (here too, only two are shown) are mounted on the top of the suction anchor 28. Wire ropes 58, 59 (alternatively fibre rope or the like) run in several lengths between the sheaves and ends 60 of the wire rope in each block tackle run to two winches 61 (only one end and one winch are shown in FIG. 8).

The suction anchor 28 is shown parked under the floater deck, i.e., under the horizontal beam 9. The suction anchors may also be stored on the floater deck.

When the suction anchors are to be dropped they are taken down to the seabed by being lowered using the respective block and tackle systems, each of which will constitute an adjustable tether 31, see FIG. 5. During the initial penetration of a suction anchor into the seabed it is important that the suction anchor is not jerked out of the seabed (owing to movements of the floater). In this phase of the operation it is desirable to be able to adjust the force which the suction anchor exerts on the seabed owing to gravity.

Winches are normally too slow to be able to compensate for the motion of the floater. For this reason, the hydraulic jacks 50, 51 are actuated and they are used as passive heave compensators in this phase.

A pump device on the respective suction anchor is used to generate negative pressure in the anchor and the anchor is sucked down into the seabed to a desired depth of penetration.

Once the suction anchors have been installed on the seabed the tethers, i.e., the ropes between the sheaves, are tensioned, by deballasting the floater and by adjusting the hydraulic jacks.

The deballasting will require a certain time before the desired force is obtained in the tethers. It is desirable that there should be no slack in the tethers as a result of the motion of the floater during the deballasting stage. This can in fact lead to jerks in the tethers and suction anchors. In this phase the hydraulic jacks 50, 51 will ensure that the tethers are held taut by pushing the upper sheaves 54, 55 upwards a distance corresponding to that which the floater goes down when the trough of a wave passes the floater. The hydraulic jacks 50, 51 lock hydraulically when the floater is in its lowermost turning position, where speed and kinetic energy are zero. The floater is retained in this position by the tethers when the next crest of a wave passes the floater. Until a sufficient force is obtained in the tethers, the floater can move further down if a deeper trough passes the floater, and the hydraulic jacks then lock again when the floater is in its lowermost turning position.

To this end, each individual hydraulic jack is provided with a check valve 62 in the hydraulic supply line 63, as is shown for the hydraulic jack 51. The advantage of the system described here is that the tethers will not be subjected to forces required to brake the kinetic energy when the floater moves, so that the tethers in fact only need to take up the forces originating from the static pretensioning of the tethers and external environmental loads from waves.

The static pretensioning is set somewhat higher than the single amplitude of the forces from the waves in order to prevent slack from occurring in the tethers during the further progress of the operation.

After penetration, the floater will be anchored by the suction anchors, and the tethers will be pretensioned to the desired force. A clearing is provided between the floater and the deck structure which is to be lifted during the installation phases of the suction anchors to avoid impact between the floater and the deck structure as a consequence of motions of the floater.

The floater reduces its draught (and clearing between floater and deck structure) by being deballasted and at the same time lowering rope from the winches 61. The static pretensioning in the tethers is maintained at a constant level to avoid slack in the tethers (and thus motions of the floater).

To ensure that the weight of the deck structure is distributed as desired to the floater, compensating jacks or compressive bearings, spacers, wedges etc may be used on the floater.

Load transfer of the deck structure from the pylon to the floater takes place by deballasting the floater. The physical connection between the deck structure and the pylon is cut.

When 100% of the weight of the deck structure has been transferred to the floater the hydraulic jacks in the tether system are used to obtain rapidly a clearing between the deck structure and the pylon structure which remains anchored to the seabed (to prevent impact between the structures owing to the motions of the floater).

The suction anchors are pumped up from the seabed with the respective pump devices connected to the suction anchors and are hoisted up to parking position on the floater by means of the winches 61.

Figure 7:
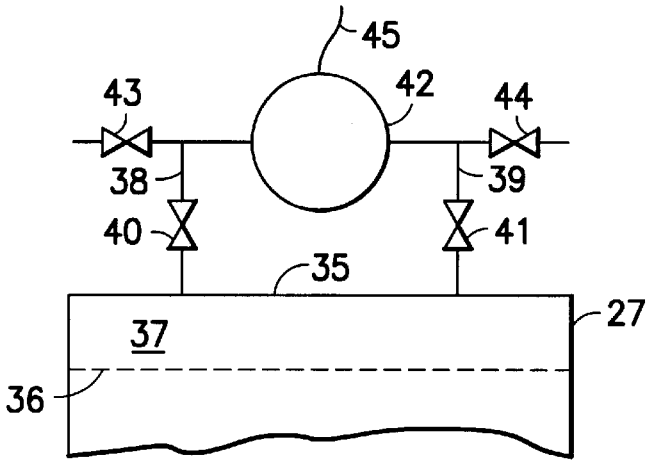
FIG. 7 shows a pump arrangement for a suction anchor.

As mentioned, it is advantageous to use suction anchors with attached suction pumps for provision and maintenance of the negative pressure in the respective suction anchors. A possible suction pump arrangement is shown in FIG. 7, where the top of a suction anchor, as an example the suction anchor 27, is shown.

The suction anchor 27 has a top plate 35 and an internal filter plate 36. The space 37 between the top plate 35 and the filter plate 36 contains two branch pipes 38, 39 with inset valves 40, 41 attached to respectively the suction side and the pressure side of a hydraulically driven pump 42. The pump 42 may be connected to the surrounding sea water through 44 on the pressure side. The hydraulic motor of the pump is supplied with hydraulic driving medium through the hose 45.

On suction, i.e., the provision and maintenance of a negative pressure in the suction anchor 27, the valves 40 and 44 are opened. The valves 43 and 41 are closed. On pressurisation (releasing the anchor), the valves 43 and 41 are open whilst the valves 38 and 44 are closed.

The crossbeam 12 shown in FIGS. 1, 3, 4,5 and 6 have a favourable streamlined profile (wing profile) with respect to resistance in the water.

FIGS. 2 and 3 show a hinged boom device 14. The opening of the U can be closed and braced by means of this device. The boom has been omitted in FIG. 5. Instead of the illustrated boom device there may be used, for example, reinforcing, pivotally supported underwater bars which can connect the pontoons 1, 2 to one another.

The floater is equipped with dynamic positioning coupled to the propulsion units and also a fender system for the horizontal positioning of the floater. The dynamic positioning system will, compensate for most of the static environmental loads to which the floater may be subjected (wind, waves, current) and the fender system between floater and pylon (fender systems are not shown) will then take up the dynamic components of the environmental load.

What is claimed is:

1. A method for offshore load transfer operations, wherein a floater comprising two parallel groups of elements, each group comprising a pontoon having a horizontal axis and, projecting upwards from the pontoon, columns which at the upper ends thereof are connected to a respective horizontal support, is taken to a transfer site at sea and loads are transferred between the transfer site and the floater, the floater prior to the load transfer being anchored to the seabed by means of anchors, wherein the anchoring is carried out by:

placing suction anchors connected to the floater by means of attached adjustable tethers on the seabed directly from the group of elements, and adjusting each individual tether to attenuate relative motions between floater and seabed and to attenuate rolling motions of the floater during a load transfer.

2. A floater having adjustable buoyancy for offshore transport, installation and removal of structural elements, which floater comprises two parallel groups of elements, each group comprising a pontoon having a horizontal axis and, projecting upwards from the pontoon, columns which at the upper ends thereof are connected to a respective horizontal support, and the groups are fixedly interconnected at one end to form a floater that is U-shaped in plan view, wherein:

in an area at corners of the U and at an end of each leg of the U there is arranged a respective storage/deployment apparatus for a suction anchor, each suction anchor is equipped with attached adjustable tethers, and the suction anchors are so arranged that during load transfer operations of structural elements they can be placed in the seabed in such manner as to enable relative motions between floater and seabed and rolling motions of the floater to be attenuated by adjusting the attached adjustable tethers.

3. A floater according to claim 2, wherein each individual suction anchor is attached to a pump device for the provision and maintenance of a negative pressure in the suction anchor.

4. A floater according to claim 3, wherein the suction anchors are stored above the waterline.

5. A floater according to claim 3, wherein:

each pontoon is provided with one or more propulsion units in each of its end areas, and each pontoon has a respective bottom which is drawn up at each end in order to make room for the respective propulsion unit so that it does not project down below the bottom.

6. A floater according to claim 3 wherein the fixed connection between the groups below the waterline consists of a crossbeam having a wing profile between the two pontoons.

7. A floater according to claim 3 wherein the horizontal supports include gravity discharge ballast tanks.

8. A floater according to claim 2, wherein the suction anchors are stored above the waterline.

9. A floater according to claim 8, wherein:

each pontoon is provided with one or more propulsion units in each of its end areas, and each pontoon has a respective bottom which is drawn up at each end in order to make room for the respective propulsion unit so that it does not project down below the bottom.

10. A floater according to claim 8 wherein the fixed connection between the groups below the waterline consists of a crossbeam having a wing profile between the two pontoons.

11. A floater according to claim 8 wherein the horizontal supports include gravity discharge ballast tanks.

12. A floater according to claim 2, wherein:

each pontoon is provided with one or more propulsion units in each of its end areas, and each pontoon has a respective bottom which is drawn up at each end in order to make room for the respective propulsion unit so that it does not project down below the bottom.

13. A floater according to claim 12, wherein the respective propulsion unit is a Voith propeller.

14. A floater according to claim 13 wherein the fixed connection between the groups below the waterline consists of a crossbeam having a wing profile between the two pontoons.

15. A floater according to claim 13 wherein the horizontal supports include gravity discharge ballast tanks.

16. A floater according to claim 12 wherein the fixed connection between the groups below the waterline consists of a crossbeam having a wing profile between the two pontoons.

17. A floater according to claim 12 wherein the horizontal supports include gravity discharge ballast tanks.

18. A floater according to claim 2, wherein the fixed connection between the groups below the waterline consists of a crossbeam having a wing profile between the two pontoons.

19. A floater according to claim 18, wherein the horizontal supports are connected to one another at one end above the wing profile by means of a horizontal crossbeam.

20. A floater according to claim 19 wherein the horizontal supports include gravity discharge ballast tanks.

21. A floater according to claim 18 wherein the horizontal supports include gravity discharge ballast tanks.

22. A floater according to claim 2, wherein the horizontal supports include gravity discharge ballast tanks.

* * * * *